US006659324B1

(12) United States Patent
Liu

(10) Patent No.: US 6,659,324 B1
(45) Date of Patent: Dec. 9, 2003

(54) SINGLE-FIRING TRIGGER MECHANISM FOR A NAILING MACHINE

(76) Inventor: Chung-Ho Liu, No.52, Lane 557, Dingtai Rd., Wufeng Shiang, Taichung County (TW)

( * ) Notice: Subject to any disclaimer, the term of this patent is extended or adjusted under 35 U.S.C. 154(b) by 0 days.

(21) Appl. No.: 10/440,370

(22) Filed: May 20, 2003

(51) Int. Cl.[7] ..... B25C 1/04
(52) U.S. Cl. ..... 227/8; 227/130
(58) Field of Search ..... 227/8, 130, 156; 173/170

(56) References Cited

U.S. PATENT DOCUMENTS 5,551,621 A * 9/1996 Vallee ..... 227/130
5,791,545 A * 8/1998 Lin ..... 227/8
5,836,501 A * 11/1998 Lai ..... 227/130
6,116,488 A * 9/2000 Lee ..... 227/8
6,213,372 B1 * 4/2001 Chen ..... 227/8
6,422,446 B1 * 7/2002 Liu ..... 227/130
6,588,642 B1 * 7/2003 Wang et al. ..... 227/8

* cited by examiner

*Primary Examiner*—Scott A. Smith
(74) *Attorney, Agent, or Firm*—Kuo-Hsiung Chiu

(57) ABSTRACT

The invention relates to a single-firing trigger mechanism for a nailing machine with a receptacle for receiving a swiveling element pivotably on a second positioning shaft. The other end of the swiveling element with a torsion spring is pivotally connected to a contact element on a third positioning shaft and, in addition, the top end of the contact element is disposed at a height to be in contact with a safety lever. The safety lever should be extended into the inside of the trigger and pressed against the contact element so as to be shifted in the direction of the firing pin. Thereafter, the user can press down the trigger again, thereby causing the contact element to be in contact of the firing pin for the next single-firing operation.

1 Claim, 6 Drawing Sheets

SINGLE-FIRING TRIGGER MECHANISM FOR A NAILING MACHINE

BACKGROUND OF THE INVENTION

1. Field of the Invention

The invention relates to an improved structure of a trigger of a nailing machine, and more particularly, for exactly reaching the single-firing effect.

2. Description of the Related Art

Nailing machines can be very dangerous tools. The operation thereof must be very careful in order not to injure persons around the working place. As shown in FIGS. 7 and 8, the trigger mechanism 20 of a conventional nailing machine 10 includes a trigger 21, a torsion spring 22, a slide piece 23 and a spring 24. Under normal operation, a safety lever 12 at the front end of gun mouth 11 has to be compressed against a workpiece (not shown) for shifting the safety lever 12 inwardly and, therefore, the other end 13 thereof is pressed against the torsion spring 22 to be shifted backwards. At that time, the other end 221 of the torsion spring 22 presses the slide piece 23 to be shifted downwardly (see FIG. 9). When the slide piece 23 is moved downwards, a position difference is created between a deep hole 231 adjacent to the middle part of the slide piece 23 and a firing pin 14. By pressing down the trigger 21, a single-firing effect is reached. Under the precondition that the safety lever 12 is not moved inwardly, the firing pin 14 can extend into the deep hole 231 of the slide piece 23 (see FIG. 11) when the operator presses down the trigger 21. Therefore, the safety effect to prevent from firing is reached.

Referring to FIG. 10, the trigger is in a compressed state after firing. If the operator unintentionally cause the safety lever 12 to be in contact with any object, an unexpected nailing effect is also created since the slide piece 23 is situated in the compressed state, too. In other words, the spring 24 can't move the slide piece 23 upwardly to the safety position due to the continuous frictional relationship between the slide piece 23 and the firing pin 14, thereby leading to tremendous operational danger.

SUMMARY OF THE INVENTION

It is a primary object of the present invention to remove the above-mentioned drawbacks and to provide a safer trigger mechanism. After completion of an expected single firing operation, the contact piece touching the firing pin can be automatically removed from or spring away from the safety level. Under the precondition that the trigger is not released in place, the next firing operation is disabled no matter which object the safety lever touches, unless the trigger is released in place according to standard operational procedure.

BRIEF DESCRIPTION OF THE DRAWINGS

The accomplishment of this and other objects of the invention will become apparent from the following description and its accompanying drawings of which.

DETAILED DESCRIPTION OF THE PREFERRED EMBODIMENT

Figure 1:
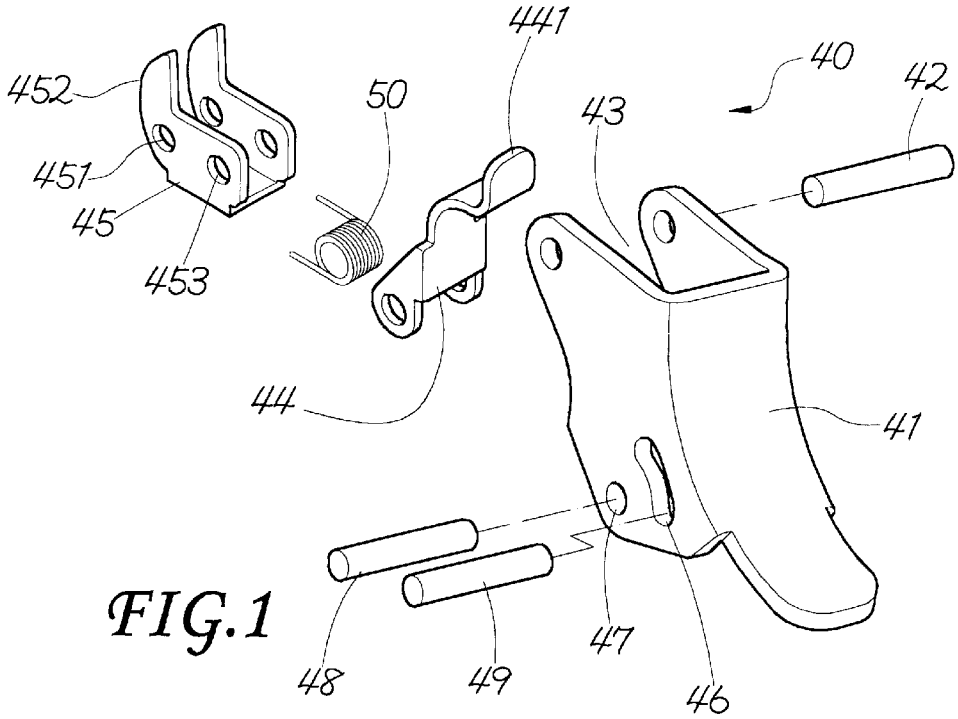
FIG. 1 is a perspective exploded view of a trigger mechanism in accordance with the invention.
Figure 2:
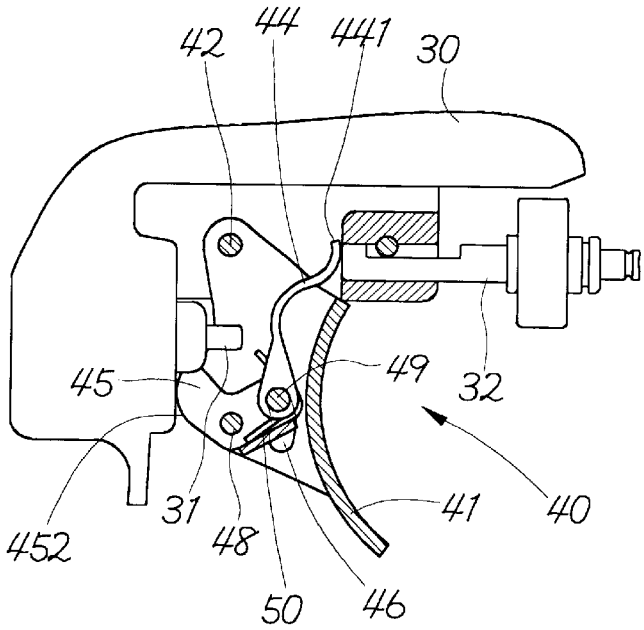
FIG. 2 is a sectional view of the assembled trigger mechanism in accordance with FIG. 1, which is attached to the nailing machine.

First of all, referring to FIGS. 1 and 2, the trigger mechanism 40 of the nailing machine 30 in accordance with the invention includes a trigger 41, a swiveling element 45 and a contact element 44.

The trigger 41 is positioned in front of the firing pin 31 and pivotally connected by a positioning shaft 42 to the nailing machine 30. Moreover, the trigger 41 has a receptacle 43 facing the firing pin 31 for receiving the contact element 44 and the swiveling element 45. An annular slot 46 and a borehole 47 are formed at each side of the trigger 41.

The swiveling element 45 is pivotably connected within the receptacle 43 of the trigger 41 by means that a second positioning shaft 48 passes through the boreholes 47 and two first holes 451 at both side plates of the swiveling element 45. An annular member 452 in contact with a vertical surface of the nailing machine 30 is formed at one end of each side plate of the swiveling element 45 while two second holes 453 are formed adjacent to the first holes 451 and aligned with the annular slot 46 of the trigger 41.

The contact element 44 is pivotally connected to the second holes 453 of the swiveling element 45 through a third positioning shaft 49 and a torsion spring 50 in a manner that the top end 441 of the contact element 44 is located at a height in contact with a safety lever 32. The third positioning shaft 49 is movably disposed within the annular slot 46 of the trigger 41.

Figure 3:
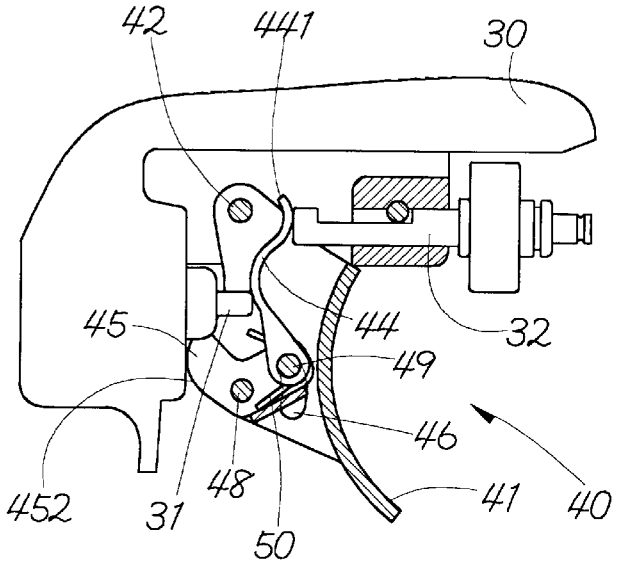
FIG. 3 is a sectional view of the assembled trigger mechanism in accordance with FIG. 2, wherein a safety lever touches a contact piece while the trigger is not pressed down.
Figure 4:
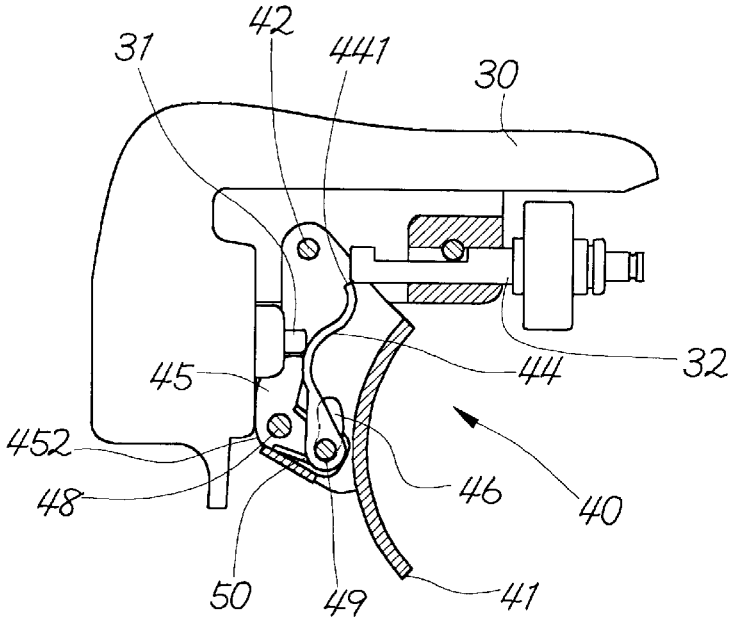
FIG. 4 is a sectional view of the assembled trigger mechanism in accordance with FIG. 3, wherein the trigger is compressed for performing the firing operation.

After assembly of the above-mentioned members, as shown in FIGS. 2, 3 and 4, and after execution of the standard operational procedure, the safety lever 32 is extended into the inside of the trigger 41 and pressed against the contact element 44 so as to be shifted in the direction of the firing pin 31. Thereafter, the user can press down the trigger 41 again, thereby causing the contact element 44 to be in contact of the firing pin 31 for the next single-firing operation.

Figure 5:
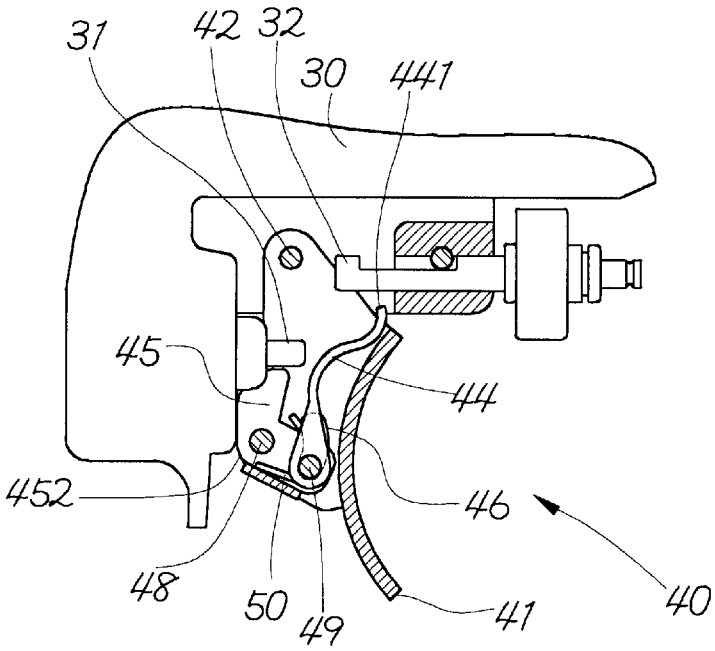
FIG. 5 is a sectional view of the assembled trigger mechanism in accordance with FIG. 4, wherein the contact piece is removed from the safety lever and the trigger is situated in a compressed state.
Figure 6:
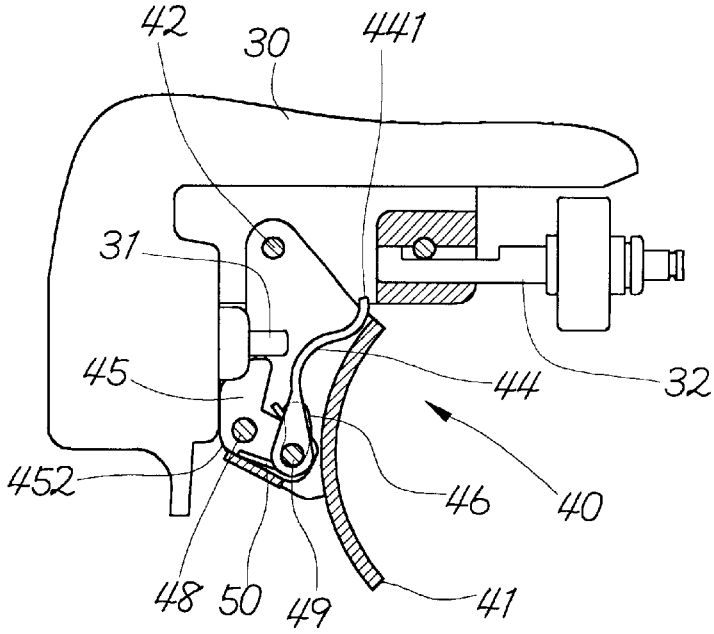
FIG. 6 is a sectional view of the assembled trigger mechanism in accordance with FIG. 2, wherein the trigger is compressed without obedience to the standard operational procedure.
Figure 7:
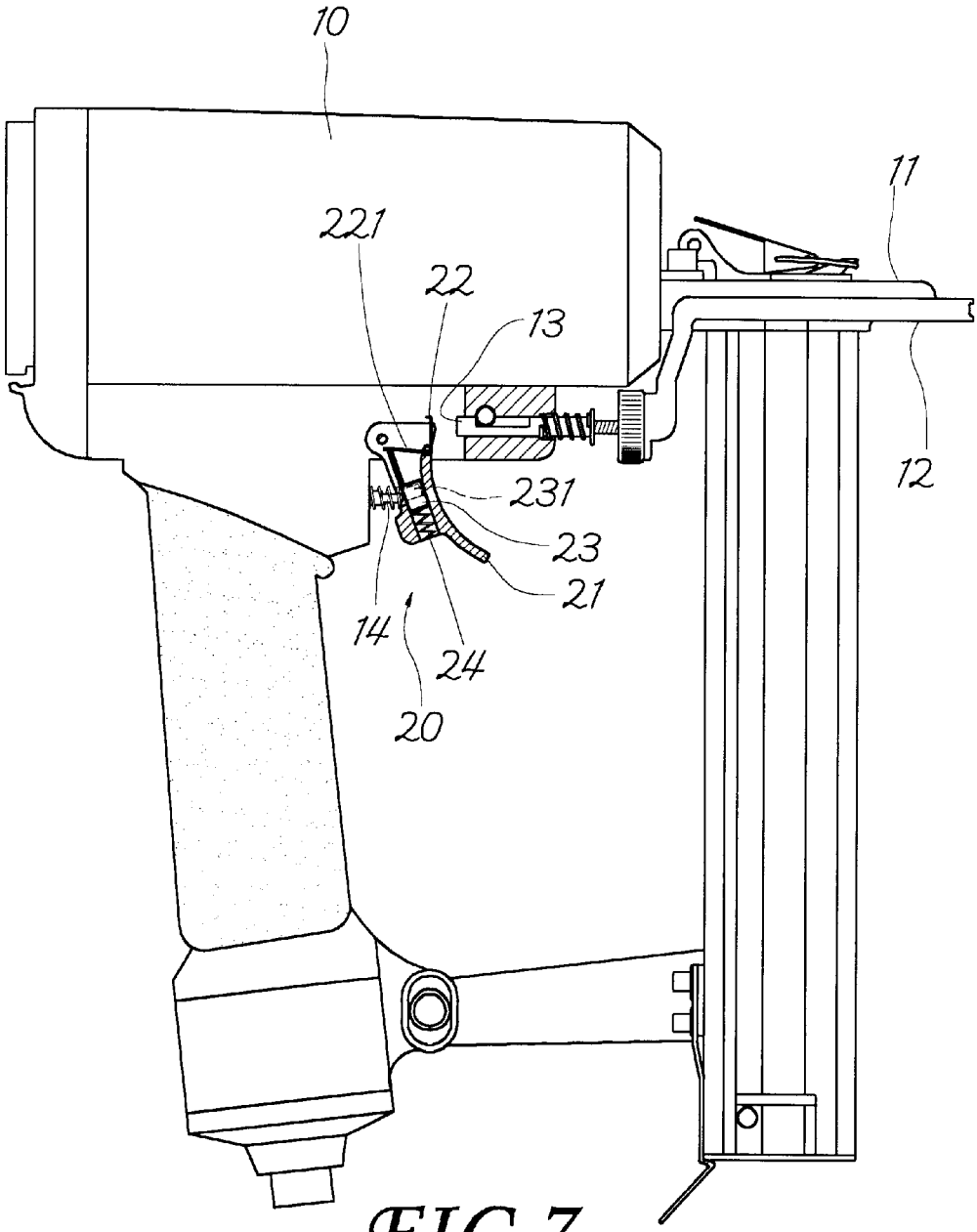
FIG.7 PRIOR ART
FIG. 7 is a side view of a conventional single-firing nailing machine with a trigger mechanism in a sectional view.
Figure 8:
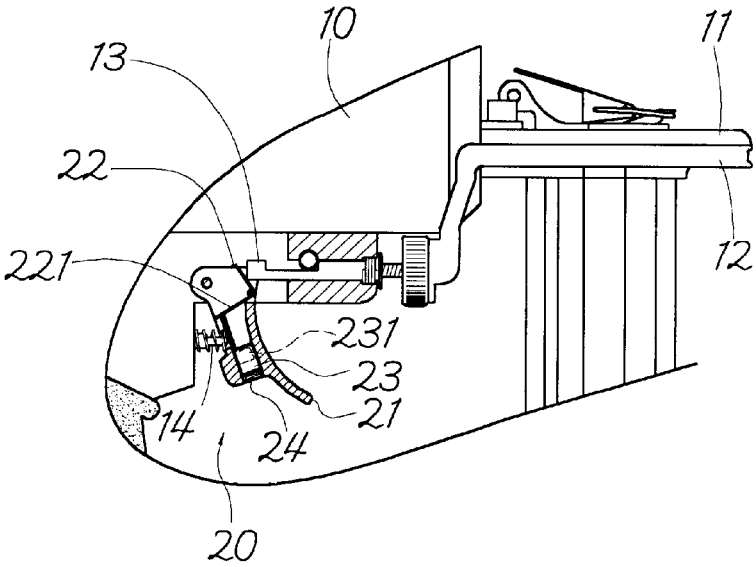
FIG.8 PRIOR ART
FIG. 8 is a sectional view of the trigger mechanism in accordance with FIG. 7, wherein the safety lever touches the torsion spring while the trigger is still not compressed.
Figure 9:
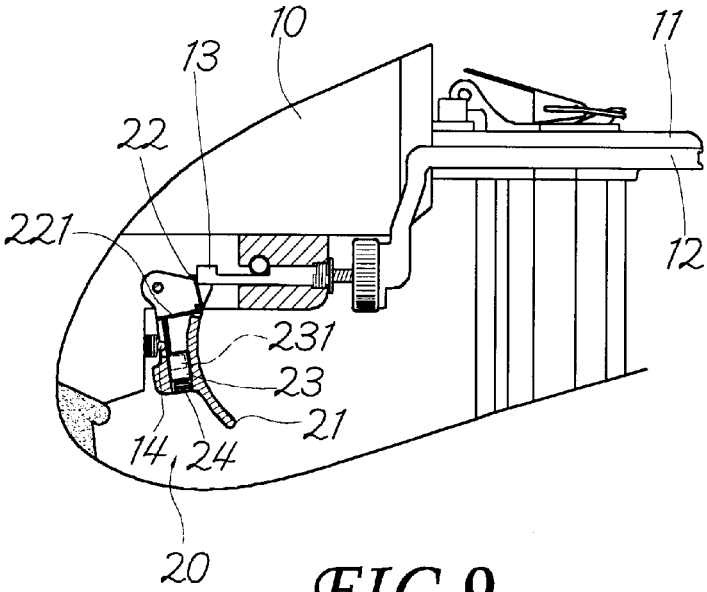
FIG.9 PRIOR ART
FIG. 9 is a sectional view of the trigger mechanism in accordance with FIG. 8, wherein the trigger is compressed for performing the firing operation.
Figure 10:
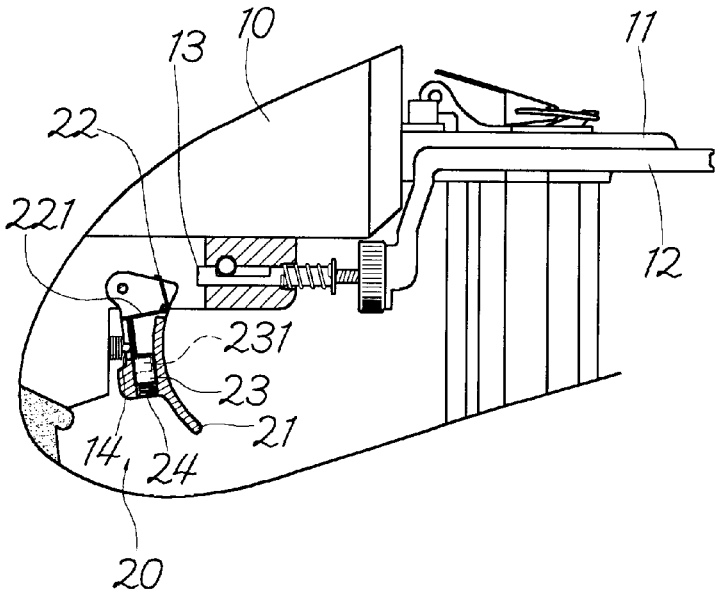
FIG.10 PRIOR ART
FIG. 10 is a sectional view of the trigger mechanism in accordance with FIG. 9, wherein the trigger is situated in the compressed state and an unexpected firing action is performed.
Figure 11:
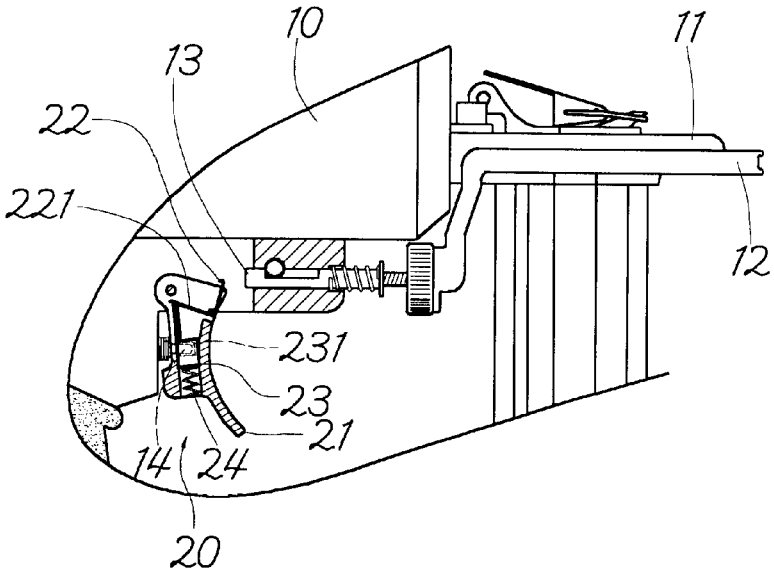
FIG.11 PRIOR ART
FIG. 11 is a sectional view of the trigger mechanism in accordance with FIG. 7, wherein the trigger is compressed without obedience to the standard operational procedure.

Now, referring to FIG. 5, the contact element 44 is removed from the safety lever 32 due to the downward movement of the whole trigger mechanism 40. Furthermore, it springs away by means of the resilient force of the torsion spring 50. Therefore, the expected effect of the single-firing operation can be reached. Moreover, the safety in use can be ensured.

If the operator compresses the trigger without obedience to the standard operational procedure, the trigger mechanism 40 will be shifted downward. Besides, the safety lever 32 can't touch the top end 441 of the contact element 44 so that the nailing operation fails.

Many changes and modifications in the above-described embodiment of the invention can, of course, be carried out without departing from the scope thereof accordingly, to promote the progress in science and the useful arts, the invention is disclosed and is intended to be limited only by the scope of the appended claim.

What is claimed is:

1. A single-firing trigger mechanism for a nailing machine comprising:

a) a trigger positioned in front of the firing pin and pivotally connected by a positioning shaft to the nailing machine, the trigger having a receptacle facing the firing pin for receiving the contact element and the swiveling element, an annular slot and a borehole being formed at each side of the trigger;

b) a swiveling element pivotably connected within the receptacle of the trigger by means that a second positioning shaft passes through the boreholes and two first holes at both side plates of the swiveling element, an annular face in contact with a vertical surface of the nailing machine being formed at one end of each side plate of the swiveling element while two second holes are formed adjacent to the first holes and aligned with the annular slot of the trigger;

c) a contact element pivotally connected to the second holes of the swiveling element through a third positioning shaft and a torsion spring in a manner that the top end of the contact element is located at a height being in contact with a safety lever, the third positioning shaft being movably disposed within the annular slot 46 of the trigger 41;

whereby, after assembly of the above-mentioned members and after execution of the normal operational procedure, the safety lever is extended into the inside of the trigger and pressed against the contact element so as to be shifted in the direction of the firing pin; and the user can press down the trigger again, thereby causing the contact element to be in contact of the firing pin for the next single-firing operation.

* * * * *